US005660020A

United States Patent [19]

Reay

[11] Patent Number: 5,660,020

[45] Date of Patent: Aug. 26, 1997

[54] METHOD OF CONSTRUCTION USING PRE-CAST FLOOR UNITS

[75] Inventor: Alan Michael Reay, Christchurch, New Zealand

[73] Assignee: Engineering Certifiers Limited, Christchurch, New Zealand

[21] Appl. No.: 518,197

[22] Filed: Aug. 23, 1995

[30] Foreign Application Priority Data

Aug. 26, 1994 [NZ] New Zealand ..... 264317

[51] Int. Cl.[6] ..... E04B 1/00

[52] U.S. Cl. ..... 52/745.2; 52/100; 52/259; 52/309.17; 52/704; 52/742.14; 52/745.21; 249/27; 249/61; 264/139

[58] Field of Search ..... 52/745.13, 742.14, 52/742.15, 251, 259, 236.9, 236.6, 250, 236.5, 98, 100, 745.05, 745.2, 745.21, 309.13, 309.17, 704; 264/139; 249/61, 27

[56] References Cited

U.S. PATENT DOCUMENTS

| | | | |
|---|---|---|---|
| 1,369,294 | 2/1921 | Painter | 52/250 |
| 1,924,801 | 8/1933 | Olmsted . | |
| 3,744,200 | 7/1973 | Rice | 52/236.9 X |
| 3,846,952 | 11/1974 | De Winter | 52/742.14 |
| 4,050,213 | 9/1977 | Dillon | 52/742.14 |
| 4,170,853 | 10/1979 | Kohaut | 52/100 X |

FOREIGN PATENT DOCUMENTS

| | | | |
|---|---|---|---|
| 296287 | 2/1954 | Switzerland | 52/250 |
| 539130 | 12/1976 | U.S.S.R. | 52/745.21 |
| 8808059 | 10/1988 | WIPO | 52/251 |

*Primary Examiner*—Wynn E. Wood
*Assistant Examiner*—Timothy B. Kang
*Attorney, Agent, or Firm*—Ross, Ross & Flavin

[57] ABSTRACT

Here is a method of construction of a multi-storey building comprising the following steps: positioning precast side slab walls on the site; each slab wall defining outer and inner wall surfaces with the inner wall surface being inclusive of a plurality of inwardly-extending cavities; positioning one or more precast floor slabs each being of appropriate dimensions for a respective floor of the building; each floor slab having secured thereon or therein one or more retaining means; engaging each retaining means in an adjacent cavity to position the floor slab as required; and securing the so-engaged retaining means such that the respective floor slab is secured relative to the side walls.

13 Claims, 3 Drawing Sheets

METHOD OF CONSTRUCTION USING PRE-CAST FLOOR UNITS

BACKGROUND OF THE INVENTION

The present invention relates to an improved method of construction of multi-storey buildings, using pre-cast floor units. The method is of particular relevance to pre-cast concrete slab buildings that are two or more storeys high.

At present there are two general methods of construction of buildings using pre-cast concrete side walls to which precast slab floors are attached. The first is to cast a smooth slab side wall and chisel out the cavity or cavities for attachment of a floor slab for the second and higher floors. This can take considerable time and be difficult to do accurately.

Alternatively the side wall slabs can be pre-cast with these cavities included. Such a method can be cumbersome in the casting process. A further drawback of such a construction method is that it may not adequately allow for the transfer of loads between the floor and the walls once construction is complete, and is awkward as these side walls must be propped apart slightly during construction.

BRIEF SUMMARY OF THE INVENTION

An object of the present invention is the provision of a method of construction which overcomes the disadvantages of the methods outlined.

The present invention provides a method of construction of a multi-storey building using pre-cast units, said method comprising:

casting a plurality of side slab walls in concrete from a mould, the or each said mould including a plurality of cavities into each of which a block of light packing material has been inserted, each said cavity being positioned adjacent a surface of the slab which surface becomes an inner wall surface when said slab is in position in a building;

positioning said side slab walls on site;

providing one or more floor slabs each of appropriate dimensions for each floor or storey of said building, each said floor slab having secured thereon and/or therein one or more retaining means that are each slidably engageable with a cavity;

engaging said retaining means to position said floor as required; and securing said retaining means in an engaged position such that the respective floor slab is secured in position to said side walls.

Preferably said method further comprises pre-casting each side wall such that a thin wall of material is formed over said block during the pre-casting, and breaking each said thin wall to reveal each said block and removing the block from the respective cavity.

Preferably each said retaining means incorporates a metal bar which is slidably engageable with said cavity, the bar being rigidly fixed to a slab and being rigidly secured within the cavity with concrete/mortar. The retaining means is then covered with a topping or infill when in position.

A cavity can be used for securing one floor on one side of each said wall, or one floor on each side of said wall when the wall is an inner wall.

BRIEF DESCRIPTION OF THE DRAWINGS

By way of example only, a preferred embodiment of the present invention is described in detail with reference to the accompanying drawings, in which.

DETAILED DESCRIPTION

Figure 1:
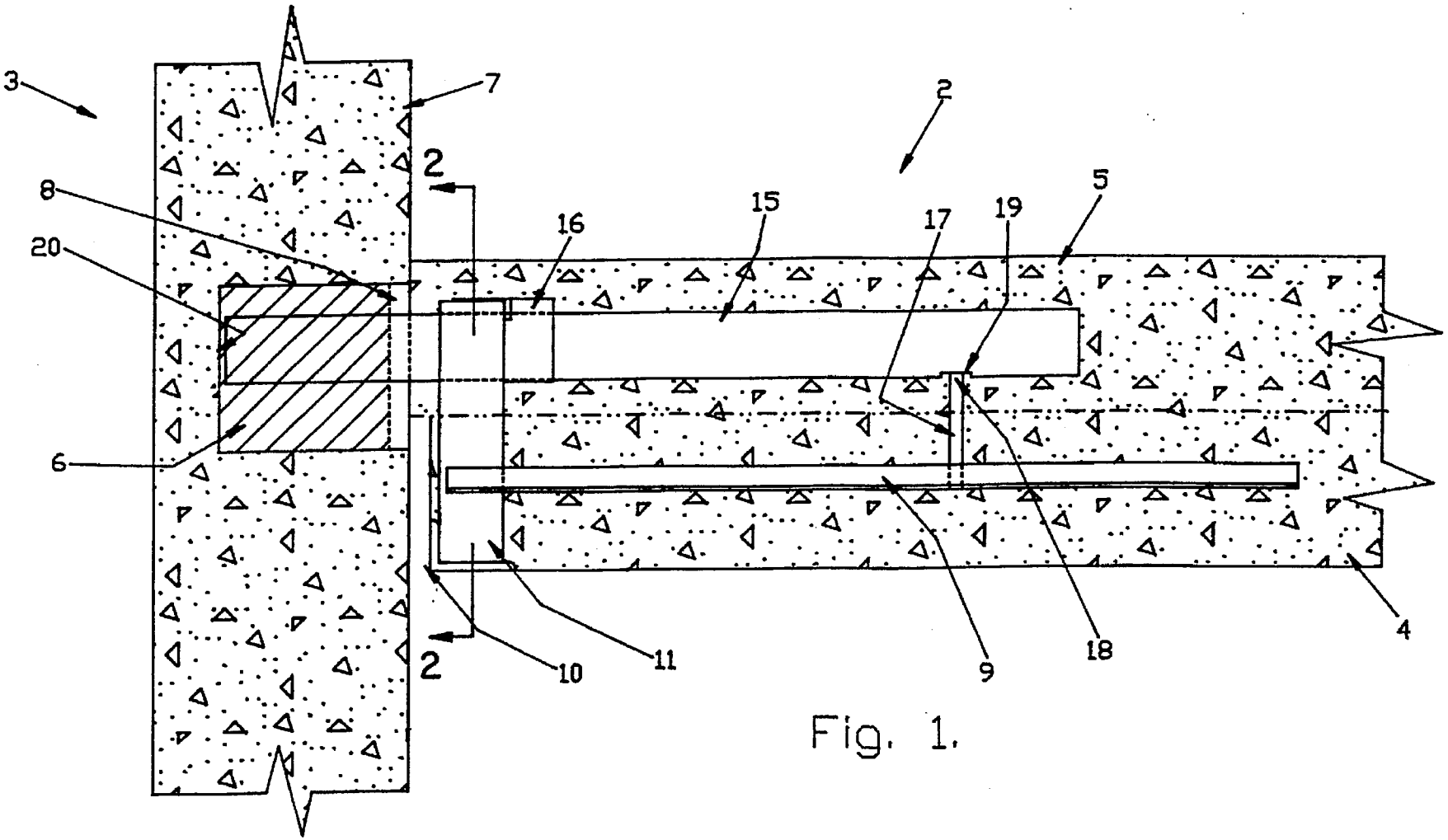
FIG. 1 is a section view through a side wall and slab floor constructed in accordance with the method of the present invention.
Figure 2:
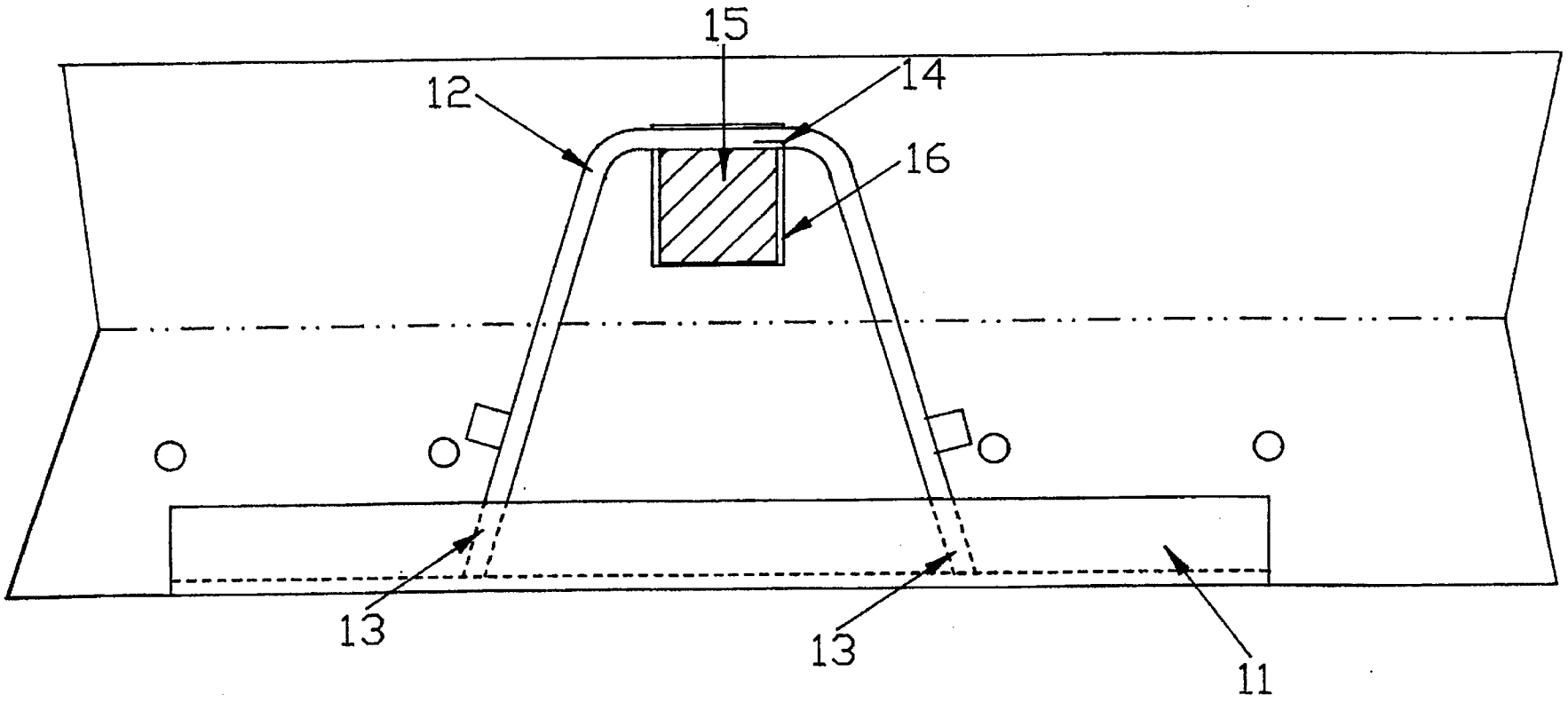
FIG. 2 is a section view along the line 2—2 of FIG. 1.

Referring to FIGS. 1 and 2, a slab floor 2 is shown secured to a side wall 3 of a building. The slab floor 2 has a lower, pre-cast concrete floor unit 4 which is pre-cast in a mould (not shown) on or off site. A concrete topping or infill 5 is shown but this is not added until after the floor 2 is in position.

The wall 3 is cast either on or off site with a cavity 6 positioned adjacent the inner surface 7 of the wall 3. The cavity is formed by the insertion of polystyrene (not shown) in the mould prior to the casting of the wall 3. The position of the cavity 6, the size of the cavity 6 and thickness of the breakaway section 8 can all be pre-determined. If so desired, a metal or concrete support (not shown) can be inserted in the cavity 6.

The floor unit 4 is pre-cast with one or more reinforcing rods 9 inserted in the mould and positioned adjacent the floor unit edge 10 which, when the unit 4 is in position, is adjacent the inner side 7 of the wall 3. A metal end cap 11 is positioned at the edge 10 and incorporates a bent metal strap 12 with two ends 13 and a top portion 14. The ends 13 are welded or formed with the end cap 11. Part way between the ends 13 and the top portion 14 an end of each of two reinforcing rods 9 is rigidly secured (for example by welding) to the strap 12. The end cap 11 projects above the top of the unit 4 to the same height (or less) as the thickness of the topping 5.

A solid square, metal bar 15 is dimensioned to slide through the end cap 11 and be precisely located within a metal collar 16. The collar 16 is of complementary dimensions to the bar 15, and secured to the top portion 14 of the strap 12. The width of the collar 16 is greater than that of the strap 12 so that it can be used to locate and position the solid bar 15 during construction. Once in position and the flooring complete the bar 15 acts to transfer loads between the concrete floor 2 and the side wall 3. If so desired, the collar 16 may be replaced with any other suitable means to secure the bar 15 under the top portion 14.

A locating pin 17 (of flat mild steel) is positioned in the mould for the unit 4 such that in the cast floor unit 4 it is secured to one or more reinforcing bars 9 with one end 18 protruding from the surface of the unit 4. A notch 19 on the underside of the square bar 15 aids in location of the square bar 15 during construction. It also aids in ease of inspection procedures during construction. Alternative locating means may be used in place of notch 19 if desired.

The floor unit 4 has been described as being of pre-cast concrete. However, it will be appreciated that a pre-constructed wooden (or other material) floor could also be used, with appropriate modification of the material for the infill 5

The method of construction is as follows: the floor unit 4 is pre-cast in a mould such that the end caps 11, reinforcing bars 9 and locating pins 17 are in the appropriate position for their intended use. The side walls 3 are pre-cast with the cavities 6 formed with polystyrene therein.

On site the walls 3 are fixed in position by known means. The breakaway section 8 for each cavity 6 is broken and removed (either before or after location of the walls 3, as is desired), as is the polystyrene within the cavity 6. The floor unit 4 is propped in position with temporary props (not shown) in known manner. A square bar 15 is inserted through each collar 16 such that one end of the square bar 15 touches or is adjacent the inner wall 20 of the cavity 6 and each locating pin 17 rests in a notch 19. If so desired, a layer of a packing material (not shown) can be inserted under the bar 15 between the end cap 11 and the locating pin 17. The packing material can be, for example, polystyrene or other soft packing.

Once the appropriate inspections have been completed the topping or infill 5 is poured. This fills the cavity 6 and covers the unit 4 so that the end cap 11, square bar 15 and collar 16 are covered. The collar 16 aids at this point in keeping the square bar 15 properly located during any construction disturbances. A surface finish or topping can be added to the top of the infill 5, if so desired. Once the infill 5 is cured the temporary props are removed.

The number and position of cavities 6 along a wall 3 for a particular floor and the thickness of a floor will depend on the construction requirements for each building. However, in practice it has been found that with a slab floor 2 thickness of 150 millimetres, placement of cavities at 600 millimetre centres for a 1.2 metre wide pre-cast floor 2 is appropriate.

Each floor 2 of the building can be so constructed. It will be appreciated that, as the walls 3 can be initially secured in their final position, the floors of a multi-storey building can be done in any order (to suit convenience) with the above method. There is no requirement that the lower (or lowest) floor be positioned and secured before any higher floor. Also, the filling in the cavity 6 when the walls 3 are pre-cast has been described as polystyrene. However, it will be appreciated that any other material that can be quickly and easily removed from a cavity in concrete can be used.

Figure 3:
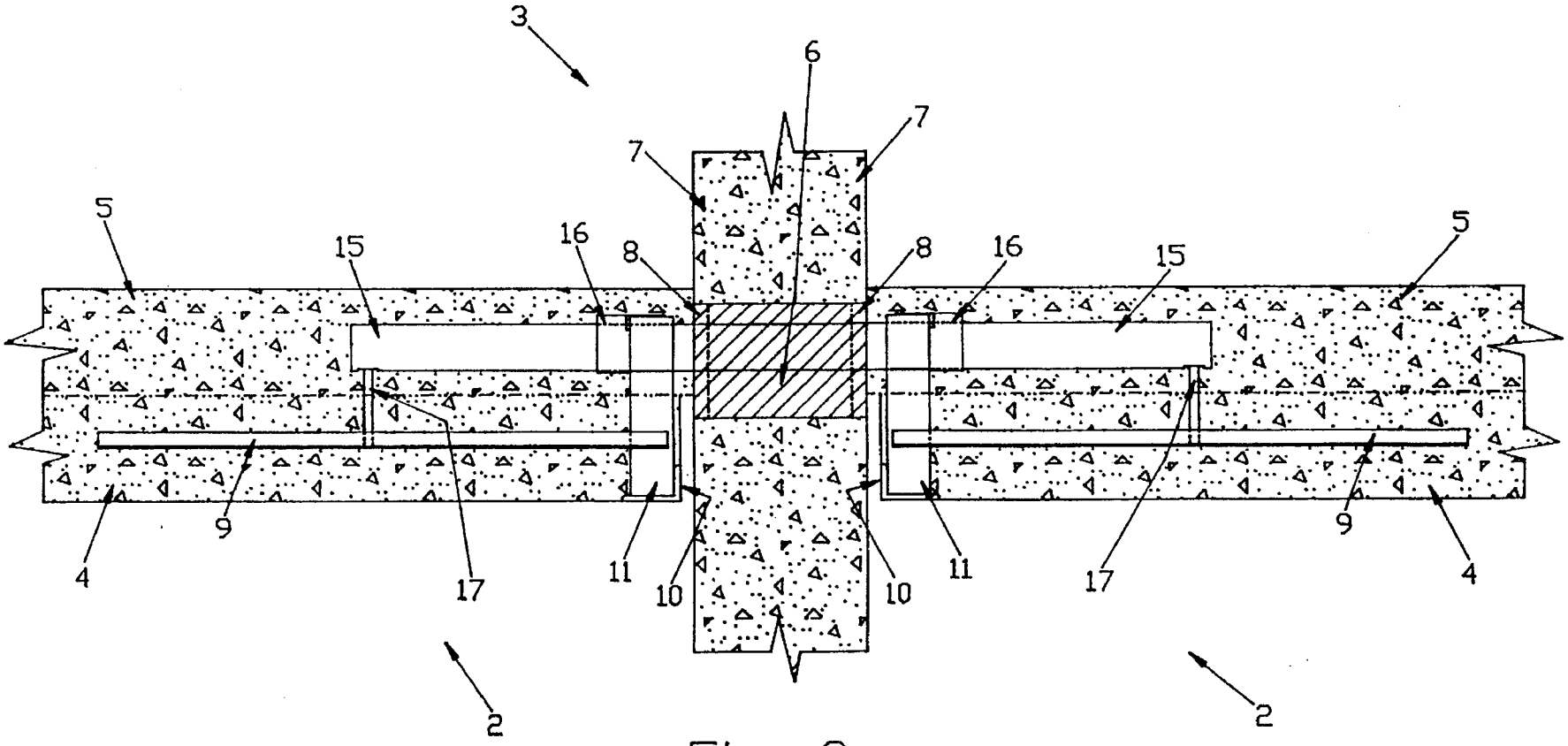
FIG. 3 is a section view of a side inner wall and slab floors constructed in accordance with the present invention.

Referring to FIG. 3 an alternative construction of the method of the present invention as thereshown. Parts shown in FIGS. 1 and 2 are numbered the same. The major difference is that the wall 3 is an inner wall and not an outer one. Thus there are floors 2 either side of the wall 3. The cavity 6 is located in the wall 3 with thin breakaway sections 8 on each face 7 of the wall 3. A single square bar 15 can be used to secure the two floors 2 to the wall 3, by passing through both collars 16 and being secured within the topping 5 on each floor 2.

The two floors can be constructed at the same time, or at separate times with minor modifications to the above method.

I claim:

1. A method of construction of a multi-storey building comprising:

positioning precast side slab walls on the site, each slab wall defining outer and inner wall surfaces with the inner wall surface being inclusive of a plurality of inwardly-extending cavities with a block of packing material within each cavity and a frangible wall covering each block, breaking the frangible walls for revealing the blocks, removing the blocks from the cavities, positioning one or more precast floor slabs each being of appropriate dimensions for a respective floor of the building, each floor slab having secured thereon or therein one or more retaining means, engaging each retaining means in an adjacent cavity to position the floor slab as required, securing the so-engaged retaining means such that the respective floor slab is secured relative to the side walls.

2. The method as set forth in claim 1 the retaining means incorporating a metal bar being slidably engaged with a respective cavity and rigidly secured within the cavity with concrete or mortar and wherein,each retaining means further comprises reinforcing rods precast in the floor slab, a metal end cap positioned at the end of each floor slab and adjacent the side walls when in position and wherein the end cap incorporates a bent metal strap rigidly secured to the reinforcing bar and a metal collar, dimensioned to receive the metal bar, which is secured to the strap.

3. The method as set forth in claim 2 wherein the end cap is formed with the strap.

4. The method as set forth in claim 2 wherein the strap is welded to the reinforcing rods.

5. The method as set forth in claim 4 and further comprising a locating means inclusive of a notch on the underside of the metal bar and a locating pin secured to one or more of the reinforcing rods, wherein the locating pin is positioned to engage with the notch when the metal bar is engaged in the cavity.

6. The method as set forth in claim 5 wherein the retaining means is secured in the engaged position by pouring and curing a topping infill over the floor slab such that it covers the retaining means and fills the cavity.

7. The method as set forth in claim 2 and further comprising a locating means which includes a notch on the underside of the metal bar and a locating pin secured to one or more of the reinforcing rods, with the locating pin being positioned to engage with the notch when the metal bar is engaged in the cavity.

8. The method as set forth in claim 7 wherein the retaining means projects above the top of the floor slab.

9. The method as set forth in claim 8 wherein the retaining means is secured in the engaged position by pouring and curing a topping infill over the floor slab such that it covers the retaining means and fills the cavity.

10. The method as set forth in claim 9 wherein the floor slab is 150 millimetres thick and the cavities are placed at 600 millimetres centres for a 1.2 metre wide pre-cast floor.

11. The method as set forth in claim 9 wherein the floor slab is constructed of wood.

12. The method as set forth in claim 9 wherein the cavities extend from one surface of the side wall slab to the other surface such that one or more floor slabs may be secured on each side of the side wall slab.

13. The method as set forth in claim 1 wherein the cavities extend from one surface of the side wall slab to the other surface such that one or more floor slabs may be secured on each side of the side wall slab.

* * * * *